US009872106B2

(12) United States Patent
Vroom et al.

(10) Patent No.: US 9,872,106 B2
(45) Date of Patent: Jan. 16, 2018

(54) HEADPHONES HAVING DISTRIBUTED MASS POWER SOURCE

(71) Applicants: Matthew Leigh Vroom, San Francisco, CA (US); Benjamin Edwards Maskell, Arlington, VA (US)

(72) Inventors: Matthew Leigh Vroom, San Francisco, CA (US); Benjamin Edwards Maskell, Arlington, VA (US)

(73) Assignee: Henge Docks LLC, Arlington, VA (US)

( * ) Notice: Subject to any disclaimer, the term of this patent is extended or adjusted under 35 U.S.C. 154(b) by 319 days.

(21) Appl. No.: 13/844,879

(22) Filed: Mar. 16, 2013

(65) Prior Publication Data

US 2014/0270232 A1 Sep. 18, 2014

(51) Int. Cl.

| | |
|---|---|
| ***H04R 1/10*** | (2006.01) |
| ***H04R 5/033*** | (2006.01) |
| *H04R 25/00* | (2006.01) |

(52) U.S. Cl.

CPC ..... *H04R 5/0335* (2013.01); *H04R 1/1025* (2013.01); *H04R 2460/17* (2013.01)

(58) Field of Classification Search

CPC .. H04R 1/10; H04R 2201/023; H04R 1/1025; H04R 5/0335; H02J 7/0054; H02J 2007/0062; H02J 50/00; H02J 7/0044; G06F 1/163; H01M 10/4207; H01M 10/465

USPC ..... 381/74, 309, 370, 374, 371; 320/114; 136/244

See application file for complete search history.

(56) References Cited

U.S. PATENT DOCUMENTS

| | | | | |
|---|---|---|---|---|
| 4,586,905 | A * | 5/1986 | Groff | 434/307 R |
| 5,708,725 | A * | 1/1998 | Ito | H04R 5/0335 381/370 |
| 7,155,025 | B1 * | 12/2006 | Weffer | 381/370 |
| 2007/0223719 | A1 * | 9/2007 | Huang | 381/74 |
| 2008/0056525 | A1 * | 3/2008 | Fujiwara et al. | 381/374 |
| 2009/0033149 | A1 * | 2/2009 | Patel | 307/10.1 |
| 2009/0207155 | A1 * | 8/2009 | Affolter | B42D 3/123 345/204 |
| 2009/0285421 | A1 * | 11/2009 | Greene et al. | 381/309 |
| 2010/0028766 | A1 * | 2/2010 | Peckerar et al. | 429/121 |
| 2013/0064412 | A1 * | 3/2013 | Alstad | H04R 1/1033 381/380 |
| 2014/0053318 | A1 * | 2/2014 | Fitzgerald | A42B 1/006 2/209.13 |
| 2014/0066130 | A1 * | 3/2014 | Yang | H04M 1/0202 455/566 |

* cited by examiner

*Primary Examiner* — Norman Yu
(74) *Attorney, Agent, or Firm* — Benjamin E. Maskell

(57) ABSTRACT

Disclosed is a device for audibly producing an audio signal including a first speaker, a second speaker, a first housing surrounding the first speaker, a second housing surrounding the second speaker, a curved member having a first curvature and connected to the first housing and the second housing, a receiver for receiving the audio signal, and an energy storage device mounted on the curved member, the energy storage device electrically connected to the receiver and having a second curvature congruent to the first curvature.

16 Claims, 9 Drawing Sheets

HEADPHONES HAVING DISTRIBUTED MASS POWER SOURCE

BACKGROUND OF THE INVENTION

Field of the Invention

The embodiments of the invention relate to an audio emitting electronic device with an embedded energy source. More particularly, the present invention relates to headphones with a rechargeable internal energy source having an evenly distributed mass for providing entertainment or communications in an audio format.

Discussion of the Related Art

Generally speaking, headphones are audio devices which consist of a pair of small speakers designed to be held in place close to a user's ears. Headphones may contain a headband which rests on the user's head so the headphones speakers remain adjacent to the user's ears. Headphones can come in a circumaural, sport, or supra-aural variety; the headband which rests on the user's head can vary for each type. The speakers in headphones can require lower electronic impedance to that of standard speakers. Low electronic impedance can accommodate the lower voltages from the batteries of common portable devices. Electronic impedance is the measure of the opposition that a circuit presents to the passage of a current when a voltage is applied.

When accommodating the lower voltages on modern portable devices, amplifiers within these devices must be designed to provide lower voltages, but higher current. As a result, lower electronic impedance headphones requiring more current from the portable electronic device may increase the consumption of electricity within the device. Related art headphones can contain a power source independent of the audio source and not rely on the audio source to supply power to the loudspeakers. Related art headphones having an independent power supply can perform at designated audio levels uniformly with a variety of devices.

While related art headphones can have an internal power supply that is independent from the audio device, the related art internal power sources consistently rely on standard sized disposable or rechargeable batteries, typically in sizes "AA" or "AAA". These standard sized batteries can be secured in a batter holder that is electronically connected to a circuit board mounted within one of housings of the headphones. As such, users of related art headphones with internal power sources are burdened with at least two inconveniences: (1) the weight of the batteries in the headphones typically falls onto one side, thereby creating discomfort to the user because the center of gravity of the headphone lies on the side of a user's head, and (2) the user incurs increased maintenance costs through the purchase of primary cell or rechargeable cell batteries for use in the headphones.

Other related art headphones have rechargeable power source(s) within one or both ends of the headphone, for example, within the earphones. Users of these related art headphones with the related art rechargeable internal power source are burdened with additional inconveniences: (1) the weight of the rechargeable internal power source, if only placed in one earphone, falls onto one side thereby creating discomfort to the user because the center of gravity of the headphone lies on the side of a user's head; (2) in related art headphones having a rechargeable energy sources on congruent ends of the headphones (typically within the opposing earphones), the weight of the rechargeable internal power source can fall onto the user's ears because the center of gravity of the headphone is on congruent ends of a user's head thereby causing discomfort and a feeling of heaviness on the user's ears after extended use; and (3) related art headphones with rechargeable internal power sources can require the user to endure a frustrating and difficult assembly process to place the rechargeable power sources within the earphones, thereby availing the headphone to improper installation of the rechargeable power sources and as a consequence, exasperating a user.

SUMMARY OF THE INVENTION

Accordingly, embodiments of the invention are directed to headphones having a distributed mass power source. More particularly, it is an object of the present invention to provide headphones having an internal power source that is widely distributed through the headband that substantially obviates one or more of the problems due to limitations and disadvantages of the related art.

The present invention is directed to a headphone that satisfies these needs. Additional objects, advantages, and novel features of the invention will be set forth in the description which follows or may be learned by those skilled in the art through reading these materials or practicing the invention. The objects and advantages of the invention may be achieved through the means recited in the attached claims.

To achieve the stated and other objects of the present invention, the present invention having features as embodied and described below, a headphone can include a curved component which is attached to a first and second housing, both housings being at opposite congruent positions, thereby connecting the housings to one another. A speaker can be embedded within each of the housings to provide sound. A receiver can be mounted on the headphone at either end and can receive either an analog or digital audio signal from an external audio device such as an MP3 player. An energy storage device can be mounted within the curved component and can provide power to the receiver and amplifier and can provide the audio signal to the speakers within the housings.

In another aspect, the curved component can be substantially U-shaped to conform to the shape of the apex of the human head. The curved component can be connected to the housing through an adjustable band that connects each of the housings to the curved component and can be mounted within the curved component. As such, an attached adjustable band can allow a user of the headphones to modify the length of the curved component and can allow the curved component to fit on a variety of head sizes.

External power can be provided to charge the internal energy storage device via a power input port mounted on one of the housings or the headband. The power input can be a DC coaxial power port or a USB port.

The energy storage device can be mounted within the curved component and can be a single energy storage device, or multiple energy storage devices that are electrically connected. An energy storage device can be flexible to conform to the curved component such as a flexible lithium polymer batter. The energy storage device can be centrally mounted within the curved component. The mass of the energy storage device or energy storage devices can be equally distributed over the curved component. The mass of the energy storage device on the left side of the curved component can be approximately equal to that of the mass on the right side of the curved component.

In embodiments of the invention the internal power source can be a plurality of rechargeable batteries such as PCB mountable lithium polymer patters. The headband can include a first energy storage device and a second energy storage device and the curved member can include a first half and a second half. The plurality of energy storage devices can be mounted in curved member such that the mass of the energy storage devices disposed on the first half is approximately equal to the mass of the energy storage devices disposed on the second half. Each of the housings can further include an energy storage device. The energy storage devices in the housing can be electrically connected to the energy storage devices in the headband or curved member.

In another aspect of the invention, headphones can have an internal power source having a mass that is distributed approximately equally over the headband. The headphones can include a first and second speaker, a first housing surrounding the first speaker and a second housing surround the second speaker, a curved member having a midpoint which is connected to the first and second housing, a receiver to receive an audio signal, a plurality of energy storage devices mounted the first side of the midpoint of a curved component, an equal number of energy storage devices of the second side of the midpoint of the curved component where the second side's mass is approximately equal to that of the first side's mass.

In another aspect, a headphone having an internal power source with an approximately equal distributed mass can include a first and second speaker, a first housing surrounding the first speaker, and a second housing surround the second speaker. A curved component having a midpoint can connect the first and second housing together and a receiver can receive an audio signal. An energy storage device can be mounted on both the first and second half of the midpoint of a curved member; the energy storage device can have a curvature on the first side that is congruent with that of the second side of the curved component. The energy storage device can be electrically connected to the receiver and speakers. Further, the mass of the first half of the energy storage device can be approximately equal to that of the mass of the second half of the energy storage device.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
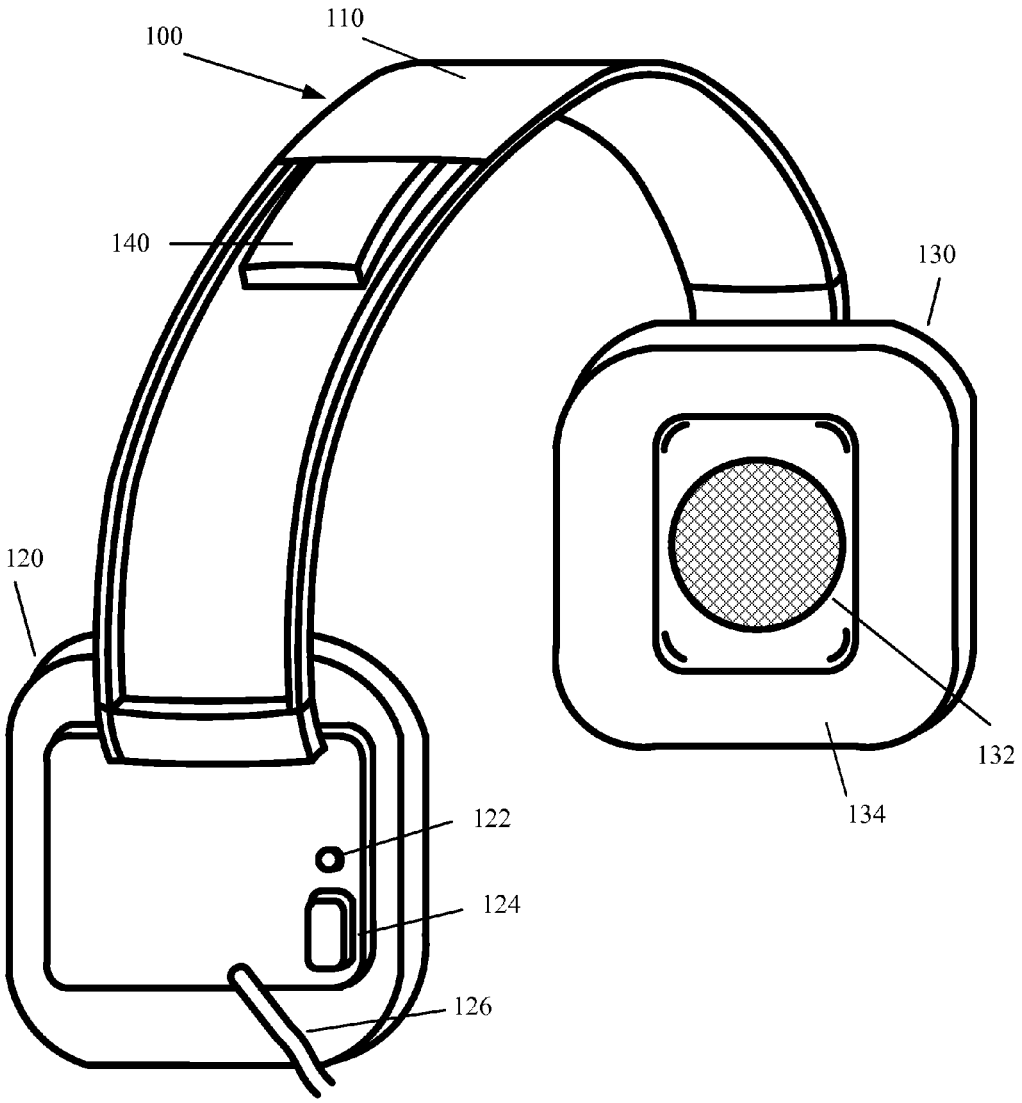
FIG. 1 is a perspective view of headphones with portions removed to expose an internal energy storage device according to an exemplary embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

FIG. 1 is a perspective view of headphones with portions removed to expose an internal energy storage device according to an exemplary embodiment of the invention. As shown in FIG. 1, the headphones 100 can include a headband 110, a left housing 120, a right housing 130, and an internal energy storage device 140. Both the left housing 120 and the right housing 130 can include an acoustic transducer 132 and can include a comfort padding 134 which surrounds the user's ear. One of the left housing 120 or the right housing 130 can include an on/off switch 124, an on/off indicator 122, a receiver 126, and a power input (not shown). The headband 110 can be connected to the left housing 120 and the right housing 130. The energy storage device 140 can be mounted inside the headband 110. Various electronic components (not shown) in the left housing 120 or the right housing 130 can be electrically connected to the internal energy storage device 140. The left housing 120 or the right housing 130 can be connected to an on/off switch 124, an on/off indicator 122, a receiver 126, an acoustic transducer 132, and comfort padding 134. The acoustic transducer 132, on/off switch 124, on/off indicator 122, and receiver 126 can be electrically connected to the internal energy storage device 140.

The left housing 120 and right housing 130 can come in a variety of sizes and shapes (not shown), including basic geometric shapes like ovals, squares, circles, to conform with a user's preferences, style, and fit. The on/off switch 124 can be a button and the receiver 126 can be wired or wireless. The headphones can include other electronic controls (not shown) such as a volume control buttons/wheel, and buttons to connect to applicable wireless frequencies. These other electronic controls can be fitted onto the left housing 120 or right housing 130. In this way, the headphones can be configured in a multitude of ways to appeal to a mass consumer market while providing consumers pricing options.

The headphone's 100 headband 110 may come in variety of types, including circumaural, sport (not shown), and supra-aural (not shown). Circumaural headphones can have a headband 110 that rests on the top of the user's head where the acoustic transducers 132 in the left housing 120 and right housing 130 are separated from a users ear by the comfort padding. Sport headphones can include a headband that rests on the back of the user's head where the occipital bone is located. Supra-aural headphones can include acoustic transducers 132 in the left housing 120 and the right housing 130 that are directly pressed against the user's ears because the headband 110 acts as a flat spring.

In the instance of circumaural headphones, the headband 110 can be substantially U-shaped, square shaped, or elliptical shaped. Depending on the shape of the headband 110, the comfort padding 134 can be placed on the inner circumference of the left housing 120 and right housing 130 adjacent a user's head. The comfort padding 134 can provide both comfort to the user and can attenuate external noise. The acoustic transducer's 132 can come in a multitude of options such as loud speakers, moving-coil drivers, electrostatic transducers, and bone conduction transducers.

The energy storage device 140 mounted on the headband 110 may be of a flexible or solid consistency. The shape of the energy storage device can be can be straight or curved. The decision of whether the energy storage device is flexible or curved can depend of a number of factors, including a necessity to conform to the headband shape or consumer pricing. In embodiments of the invention, the energy storage device 140 can be mounted such that the center of gravity is located in approximately the center of the headband 110. The energy storage device 140 can be mounted such that the mass of the energy storage device 140 is equally distributed on both sides of a midpoint (not shown) of the headband 110. The mass of the energy storage device 140 on a left side of headband 110 can be approximately equal to the mass of the energy storage device mounted on the right side of the headband 110.

The energy storage device 140 can be formed from a multitude of different electrochemical cells which are well known in the art such as nickel-cadmium, nickel-metal hydride, lithium-ion, lithium-ion polymer, lithium sulfur, and potassium-ion. The electrochemical cells can be rechargeable via an external power source. An energy storage device 140 can be flexible and can be comprised of single or multiple thin film rechargeable lithium batteries.

The headband 110 can be formed from plastic such as polypropylene, polystyrene, high impact polystyrene, polyvinyl chloride, high-density polyethylene, low-density polyethylene, polyamides, acrylonitrile butadiene styrene, polycarbonate, or polycarbonate/acrylonitrile butadiene styrene blend. The headband 110 can be formed of metal such as aluminum, alloys of aluminum, copper, alloys of copper, alloys of iron, alloys of nickel, alloys of titanium, alloys of tin, and alloys of zinc. The headband 110 can include leather, artificial leather, rubber, textiles, foam materials, silicone, vinyl, and other advanced plastics.

The comfort padding 134 can be formed of silicone, foam materials such as memory foam, rubber, polyurethane, bonded urethane, hydrogels, xerogels, and other textiles. The comfort padding 134 can be lined with leather, artificial leather, rubber, vinyl, advanced plastics, and other natural and artificial textiles.

Figure 2:
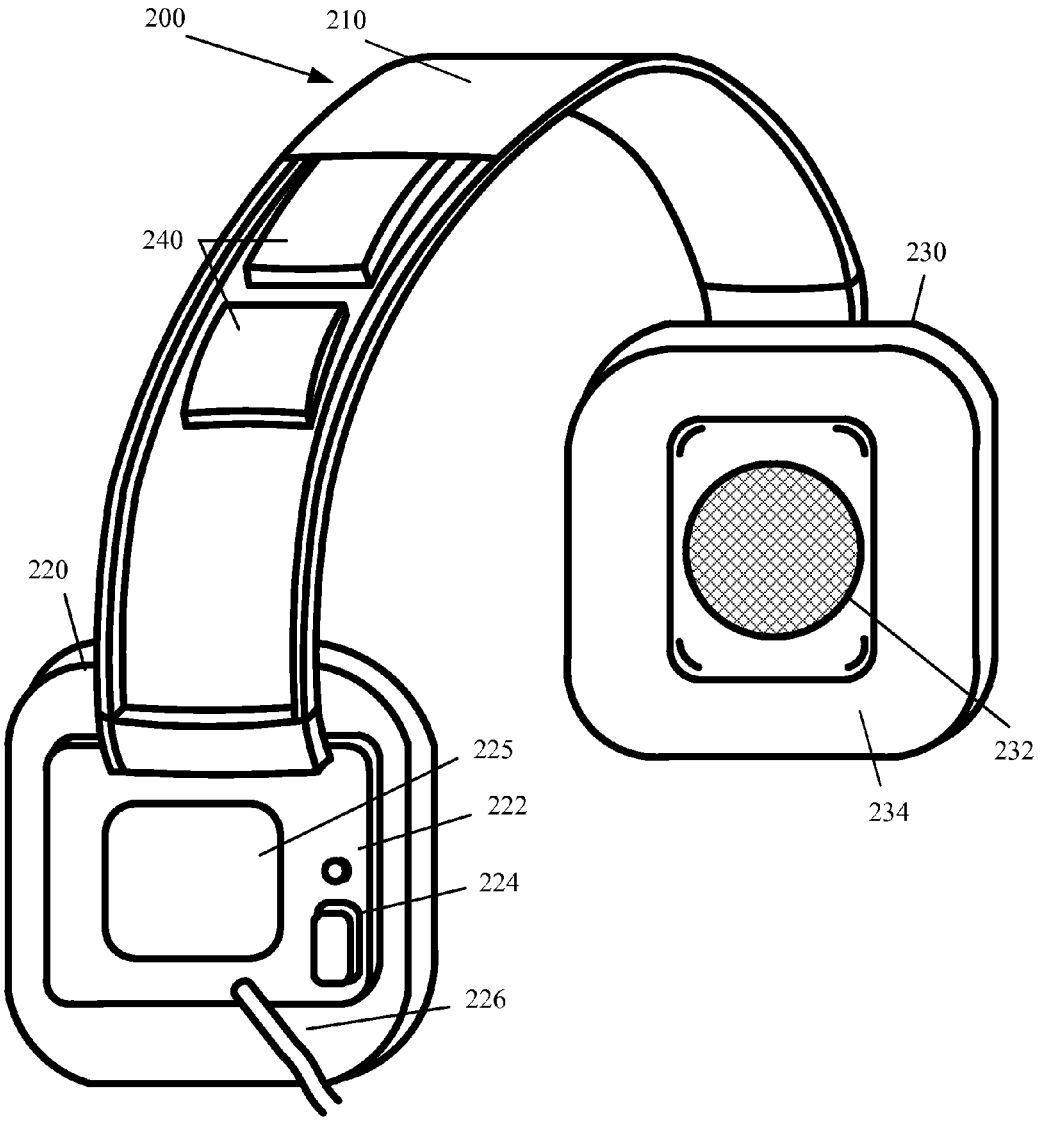
FIG. 2 is a perspective view of headphones with portions removed to expose a plurality of internal energy storage devices according to an exemplary embodiment of the invention.

FIG. 2 is a perspective view of headphones with portions removed to expose a plurality of internal energy storage devices according to an exemplary embodiment of the invention. As shown in FIG. 1, the headphones 200 can include a headband 210, a left housing 220, a right housing 230, and multiple internal energy storage devices 240. Both the left housing 220 and the right housing 230 include an acoustic transducer 232 and can include a comfort padding 234 that can surround a user's ear. One of the left housing 220 or the right housing 230 can further include an on/off switch 224, an on/off indicator 222, a receiver 226, an display 225, and a power input (not shown). The headband 210 can be connected to the left housing 220 and the right housing 230. The multiple energy storage devices 240 can be mounted on the headband 210. The multiple energy storage devices 240 can be electrically interconnected. Various electrical components (not shown) in the left housing 220 or the right housing 230 can be electrically connected to the multiple energy storage devices 240. The left housing 220 or the right housing 230 can be physically connected to the on/off switch 224, on/off indicator 222, receiver 226, acoustic transducer 232, and comfort padding 234. The acoustic transducer 232, on/off switch 224, on/off indicator 222, and receiver 226 can be electrically connected to the internal energy storage device.

The multiple energy storage devices 240 on the headband 210 can be flexible or solid. The shape of the energy storage devices can be straight or curved to conform to the shape of the headband 210. The energy storage devices can be electrically connected, such as in parallel or series, to provide the electrical power to the transducers 232 and receiver 226 and other electrical components (not shown) such as amplifier or noise cancellation processor. To maintain the center of gravity and equilibrium of the headphones 200, the mass of the energy storage devices 240 placed on the left side of headband 210 can be approximately equal to the mass of the energy storage devices placed on the right side of the headband 210. The energy storage devices can be include different electrochemical cells such as nickel-cadmium, nickel-metal hydride, lithium-ion, lithium-ion polymer, and potassium-ion.

The display 225 can be a touch screen LCD screen. The display 225 can interface with the receiver 226 to receive information from an audio transmitting device such as laptop computer or portable music player. The receiver 226 can be a Bluetooth receiver that receives song and track information from a laptop or portable music player and display relevant information on the screen 225. In embodiments where the screen 225 is a touch screen, the screen 225 can further receive inputs from a user which are transmitted via Bluetooth to an audio transmitting device to control the audio transmitting device. The inputs can be, among other things, instructions to change tracks, increase or decrease the volume, play, pause, or stop the music.

In the retail environment, the left housing 220 and right housing 230 can come in a variety of sizes and shapes (not shown), including basic geometric shapes like ovals, squares, circles, to conform with a user's preferences, style, and fit. The on/off switch 224 can be a button and the receiver 226 can be wired or wireless. The headphones can include other electronic controls (not shown), such as a volume control buttons/wheel, and buttons to connect to applicable wireless frequencies. These other electronic controls can be fitted onto the left housing 220 or right housing 230. In this manner, the headphones can be configured in a multitude of ways to appeal to a mass consumer market while providing consumers various pricing options.

The headphone's 200 headband 210 can come in variety of types, including circumaural, sport (not shown), and supra-aural (not shown). In the instance of circumaural headphones, the headband 210 can be substantially U-shaped, square shaped, or elliptical shaped. Depending on the variety of the headphone 200, a comfort padding 234 can be placed on the inner circumference of the left housing 220 and right housing 230 adjacent the user's head; the comfort padding 234 can provide both comfort to the user and can attenuate external noise. The acoustic transducers 232 can come in a multitude of options such as loud speakers, moving-coil drivers, electrostatic transducers, and bone conduction transducers.

The energy storage devices 240 mounted on the headband 210 can be flexible or solid. The energy storage devices 240 can be straight or curved to conform to the headband shape or consumer pricing. To maintain the center of gravity and an approximately equal distributed mass of the energy storage devices 240 mounted on the headphones 200, the masses of the energy storage devices mounted on the left side of headband 210 can be approximately equal to the masses of the energy storage device mounted on the right side of the headband 210.

Figure 3B:
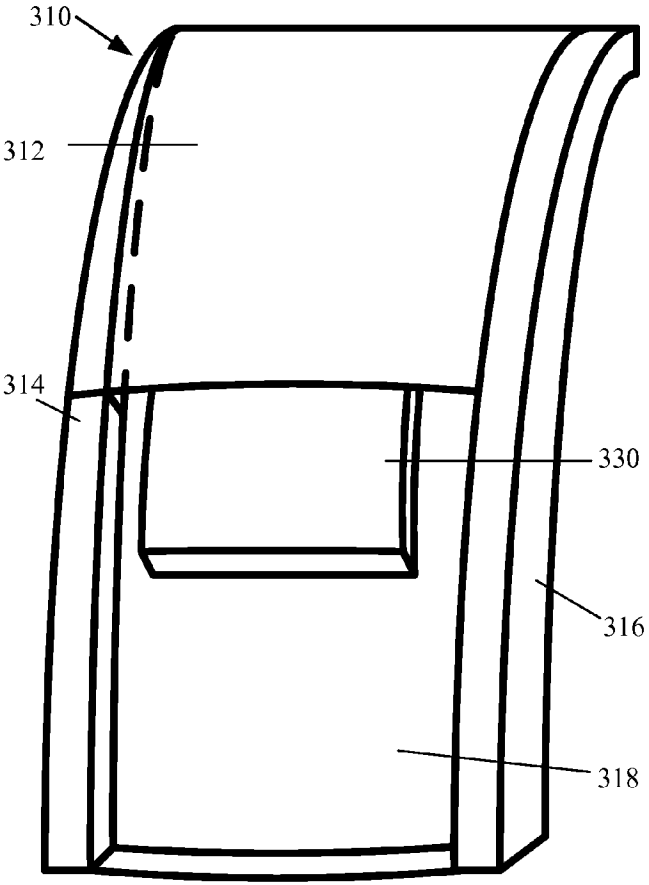
FIGS. 3A-3B are sectional perspective views of a headband with an energy storage device mounted on said headband according to an exemplary embodiment of the invention.
Figure 3A:
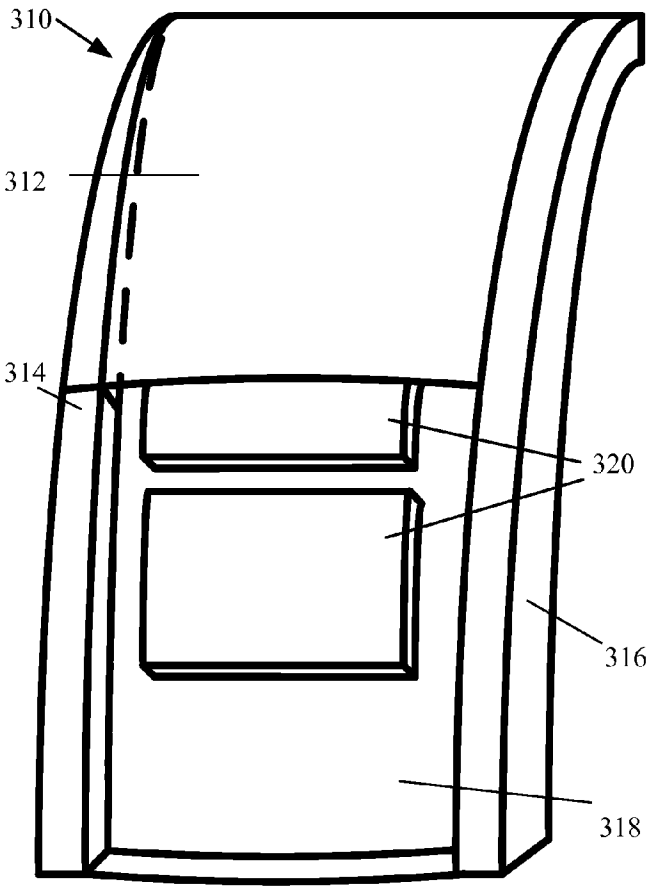

FIGS. 3A-3B are sectional perspective views of a headband with an energy storage device mounted on a headband according to an exemplary embodiment of the invention. As shown in FIGS. 3A-3B, the headband 310 includes a top layer 312, a left side wall 314, a right side wall 316, and a bottom layer 318. The culmination of the layers in the headband can provide sufficient space to mount multiple energy storage devices 320 or a single energy storage device 330. The energy storage device 320 or 330 can be straight or curved to match the curvature of the headband 310. The thickness of the headband 310 may vary depending on the style of headphones, the width of the energy storage device, and the required energy to power the receiver and acoustic transducers supplied in the headphones.

The headband 310 can be constructed in a multitude of manners thereby allowing variation in the styles and configuration thereof. The headband 310 can be one solid band as pictured, but can be split into two or more independent bands within the curvature, and at a congruent point on the opposite end of the curvature, merge into one solid band again. As such, the headband 310 can include sufficient space between the top layer 312, left side wall 313, right side wall 316, and bottom layer 318 to allow a single energy storage device 330 or multiple energy storage devices 320 to be mounted therein.

The headband 310 can include a left side wall 314, a right side wall 316, and a bottom layer 318 in which the energy storage devices 320 or energy storage device 330 can be mounted. The energy storage device 330 or energy storage devices 320 can be exposed and form the top layer of the headband 310. The exposure of the energy storage device 330 or energy storage devices 320 can be used in instances when the power input (not shown) includes photovoltaic cells mounted onto the energy storage device(s), where the photovoltaic cells can be substituted for the top layer 312. The energy storage device(s) can include a thin film flexible rechargeable battery combined with photovoltaic cells which can act as the top layer 312, the energy storage device 330 or energy storage devices 320, and power input (not shown). Such a combination can result in a headband 310 that has an energy source fueled using solar power and other external sources.

Figure 4A:
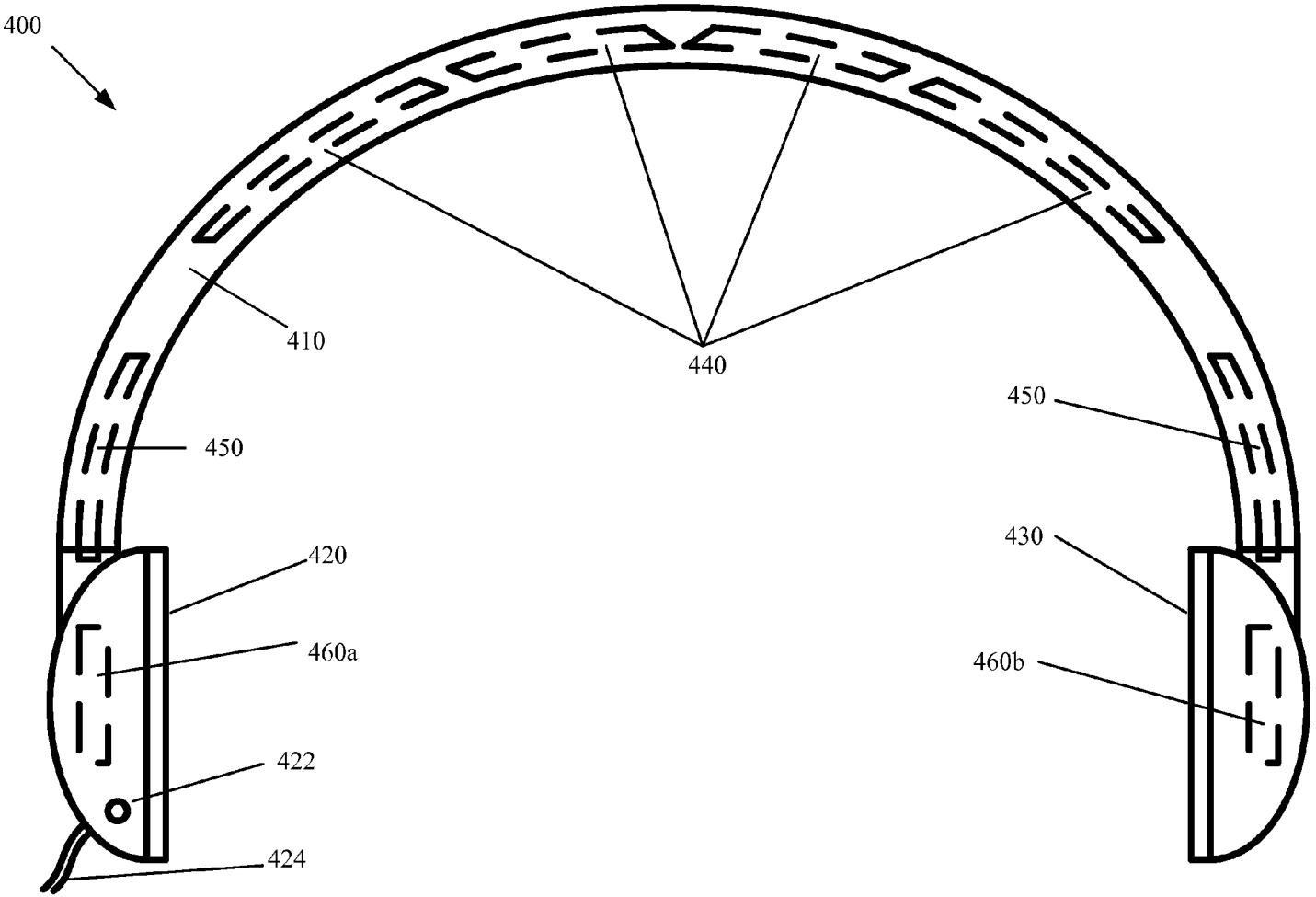
FIGS. 4A-4B are side views of headphones according to an exemplary embodiment of the invention.
Figure 4B:
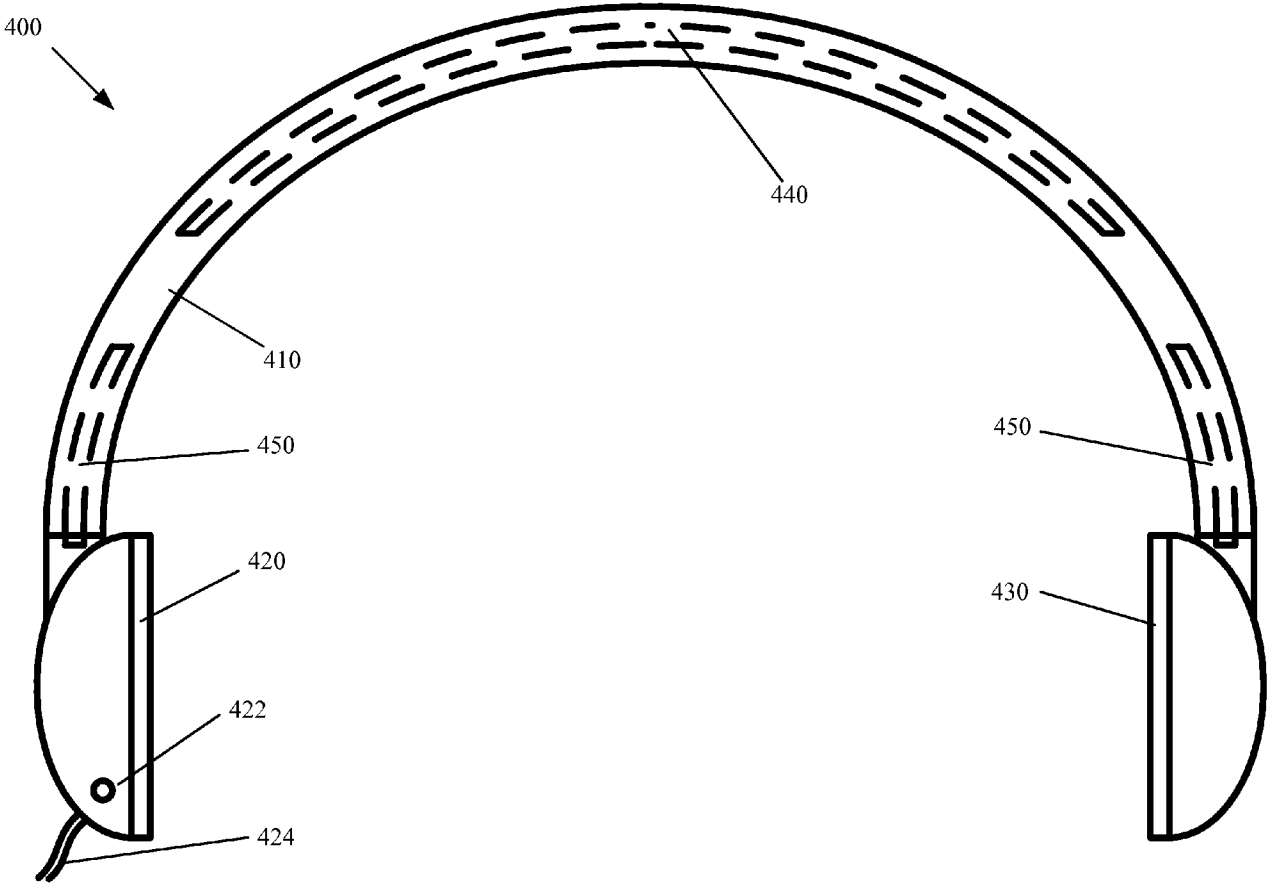

FIGS. 4A-4B are side views of headphones according to an exemplary embodiment of the invention. As shown in FIG. 4A, the headphones 400 include a headband 410, a left housing 420 including an acoustic transducer, a right housing 430 including an acoustic transducer, and multiple electronically connected energy storage devices 440 mounted on the headband 410. The energy storage devices 440 mounted in the head band 410 can be distributed such that the mass of the energy storage devices on the left side of the headband 410 is approximately equal to the mass of the energy storage devices 440 on the right side of the headband 410. One of the left housing 420 or right housing 430 can include a receiver 424 or a power port 422 for charging the energy storage devices 440. The headband 410 can be connected to the left housing 420, the right housing 430, the adjustable band 450, and multiple energy storage devices 440. The left housing 420 and the right housing 430 can be connected to the adjustable band 450. The multiple energy storage devices 440 can be electronically interconnected. The multiple energy storage devices 440 can be electronically connected to the various electrical components (not shown) in the left housing 420 and the right housing 430 such as the power port 422 and the receiver 424. The left housing 420 and right housing 430 can include additional energy storage devices 460*a* and 460*b*, respectively.

As shown in FIG. 4B, the headphones 400 include a headband 410, a left housing 420 including an acoustic transducer, a right housing 430 including an acoustic transducer, an energy storage device 440 can be mounted on the headband 410 such that the mass of the energy storage device 440 on the left side of the headband 410 is approximately equal to the mass of the energy storage device 440 on the right side of the headband 410. One of the left housing 420 or right housing 430 can include a receiver 424 and an power plug 422 for charging the energy storage device 440. The headband 410 can be connected to the left housing 420, the right housing 430, an adjustable band 450, and an energy storage device 440. The left housing 420 and the right housing 430 can be connected to the adjustable band 450. The energy storage device 440 can be electronically connected to the various electrical components (not shown) in the left housing 420 and right housing 430.

For user comfort and ease of use, the headband 410 can include an adjustable band 450 that connects the headband 410 to the left housing 420 and right housing 430. The adjustable band 450 can allow the left housing 420 or the right housing 430 to slide vertically to and from the headband 410. The adjustable band 450 can allow the left housing 420 and right housing 430 to be centered over a user's ears regardless of the size of the user's head.

Figure 5A:
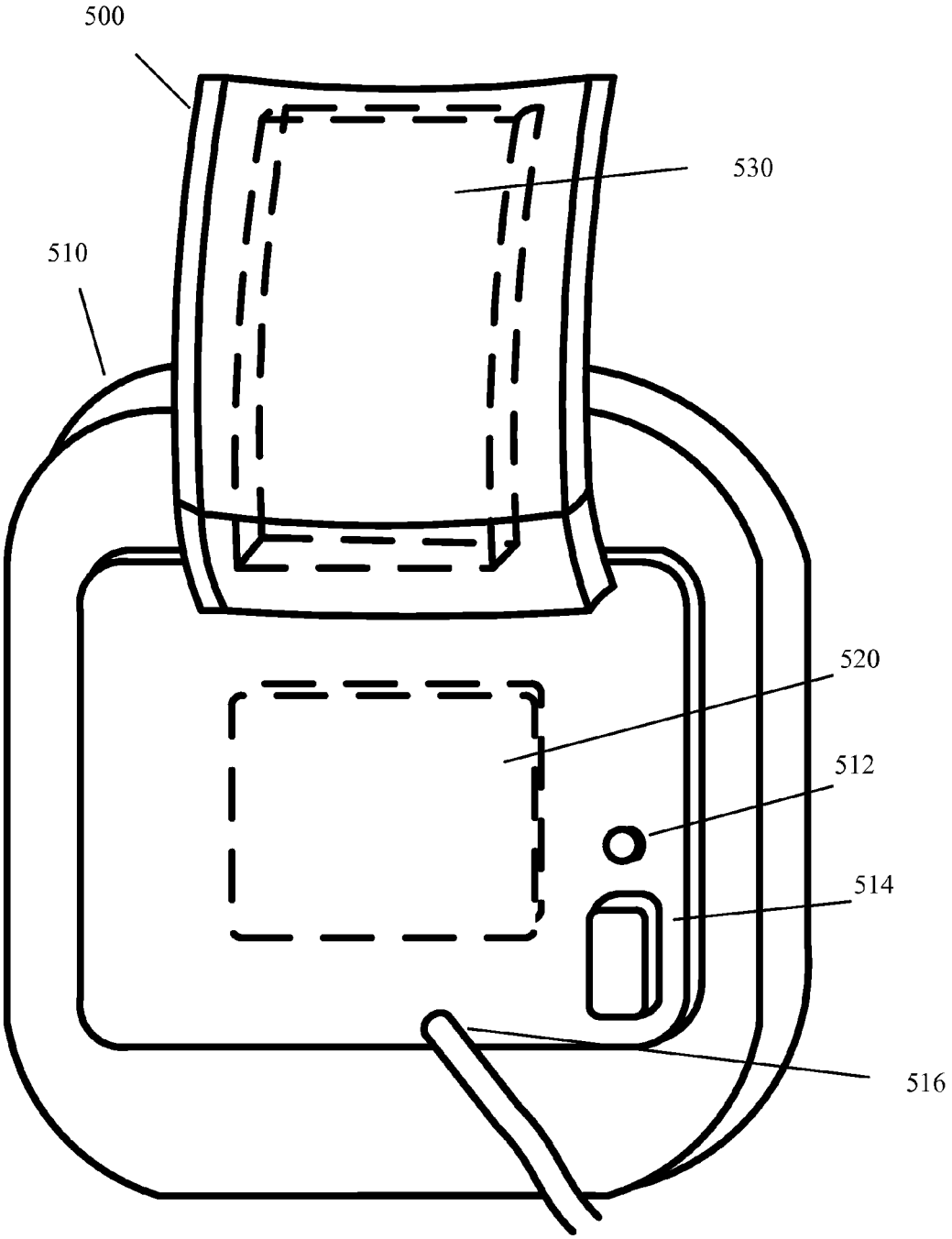
FIGS. 5A-5C are sectional perspective views of a housing for an acoustic transducer.
Figure 5B:
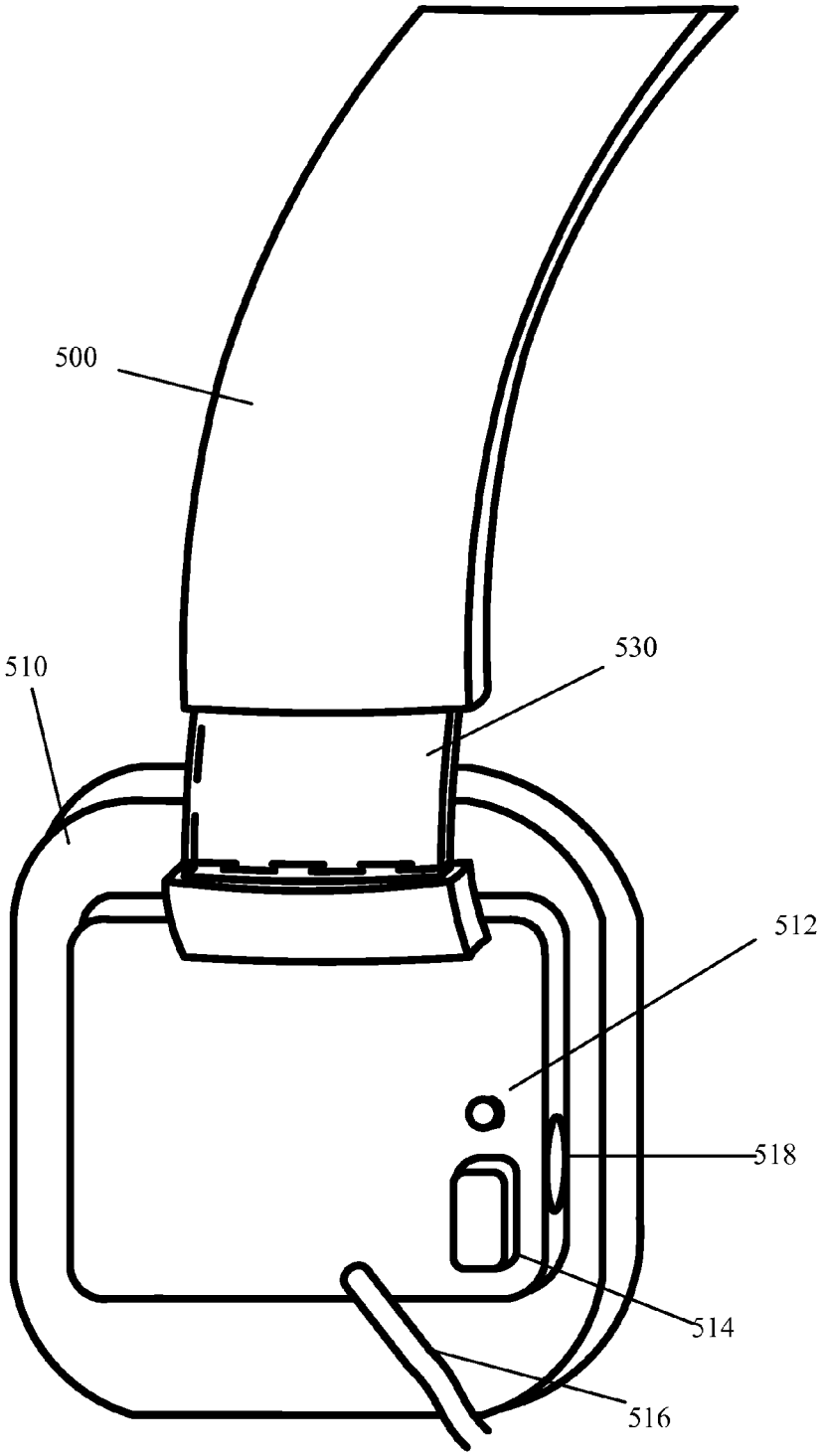
Figure 5C:
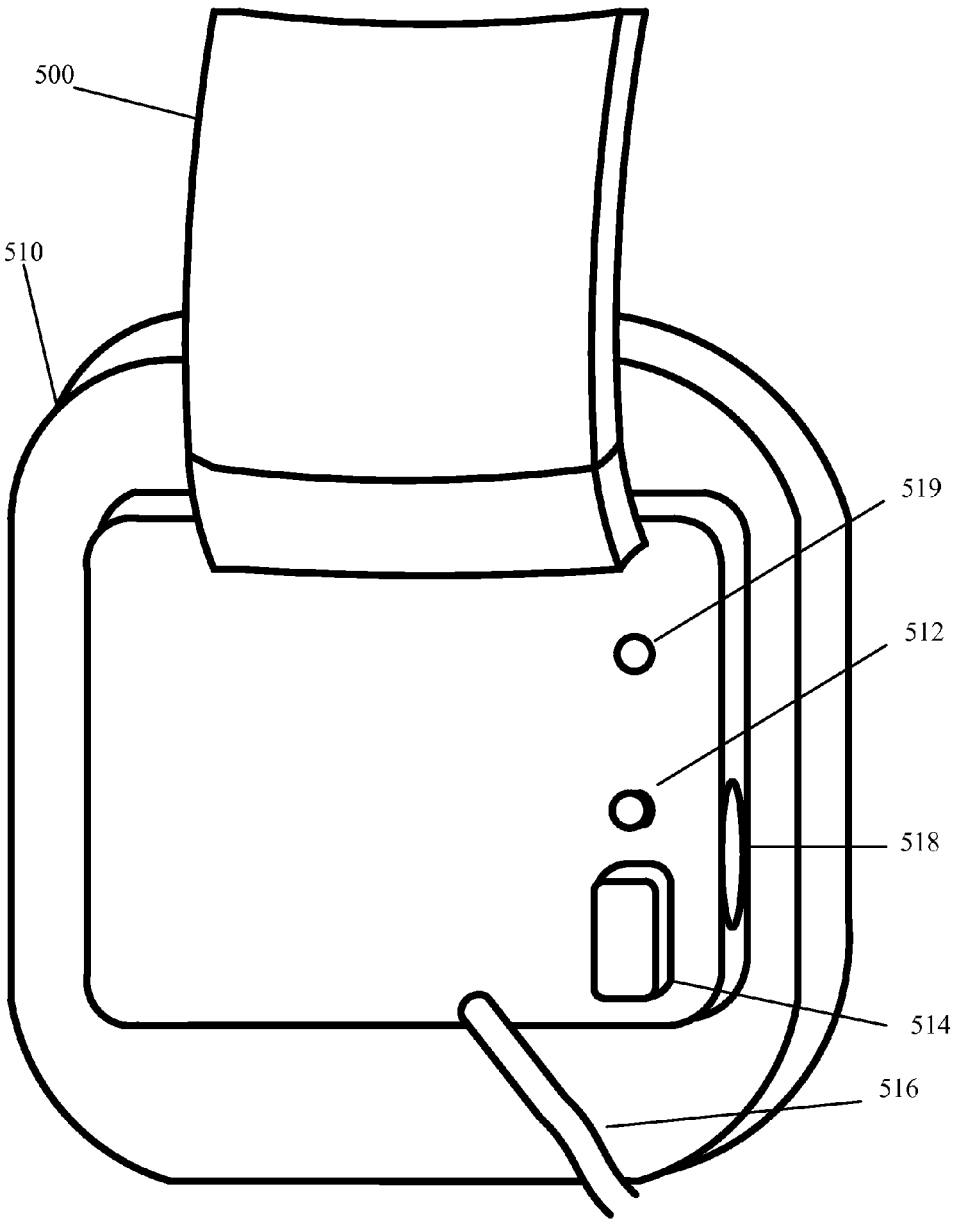

FIGS. 5A-5C are sectional perspective views of a housing for an acoustic transducer. As shown in FIG. 5A, a housing for an acoustic transducer 510 can be attached to a substantially U-shaped headband 500 via an adjustable headband 530. The housing 510 can include an on/off indicator 512, an on/off switch 514, and a receiver 516. The housing can include an energy storage device 520. Additional energy storage devices (not shown) can be mounted in the headband 500. The energy storage device 520 can be electronically connected to an on/off indicator 512, an on/off switch 514, a receiver 516, and other energy storage devices (not shown).

The adjustable band 530 can be mounted to the housing for an acoustic transducer 510 and the headband 500. The adjustable band 530 can be slidably attached to the housing 510 such that the housing 510 can slide vertically to and from the headband 500 so as to be adjustable to match the size of a user's head.

As shown in FIG. 5B, the substantially U-shaped headband 500 can be connected to a housing for an acoustic transducer 510 by a mounted adjustable band 530. The housings 510 can be located at opposite ends of the headband 500. The housing for an acoustic transducer 510 can include an on/off indicator 512, an on/off switch 514, a receiver 516, and a power input port 518. The adjustable band 530 can be exposed when the housing 510 is pulled away from the headband 500 or when the headband 500 is pulled away from the housing 510. This feature can provide an additional length to the headband 500 so as to conform to a user's head size.

A housing 510 can contain power input port 518 which can receive external power to provide energy into the energy storage devices (not shown) mounted within the headband 500. The power input port 518 can be electronically connected to an energy storage device mounted within the headband 500 (not shown) or within the housing 510. The power input port 518 can be located on various locations on the headband 500 or housing 510 to accommodate to various styles of headphones.

The power input port 518 can accept multiple types of power plugs such as a DC coaxial plug, USB plug, or a standard AC plug. Electrical power from an external source (not shown) can interface with the headphones via the power input port 518. The power input port 518 can be electrically connected to an energy storage device(s) (not shown) that are mounted within the headband 500 or the housing 510. The headphones can include a photovoltaic module (not shown) which generates electrical power from ambient light and can be used to charge the energy storage device(s) (not shown).

As shown in FIG. 5C, a housing for an acoustic transducer 510 includes an on/off indicator 512, an on/off switch 514, a receiver 516, a power input port 518, and an audio input port 519. A U-shaped headband 500 can be connected to the housing for an acoustic transducer 510. The housing for an acoustic transducer 510 can be connected to an adjustable band (not shown). The adjustable band (not shown) can retract back into the headband 500 when a user pushes the housing for an acoustic transducer 510 towards the headband, and as such, is concealed when a user pushes the housing 510. The housing 510 can include an audio input port 518 that can receive an analog audio signal via a traditional wire such as an ⅛" audio plug. The receiver 516 can receive a wireless audio signal via Bluetooth or other suitable wireless audio transmission protocol.

Figure 6B:
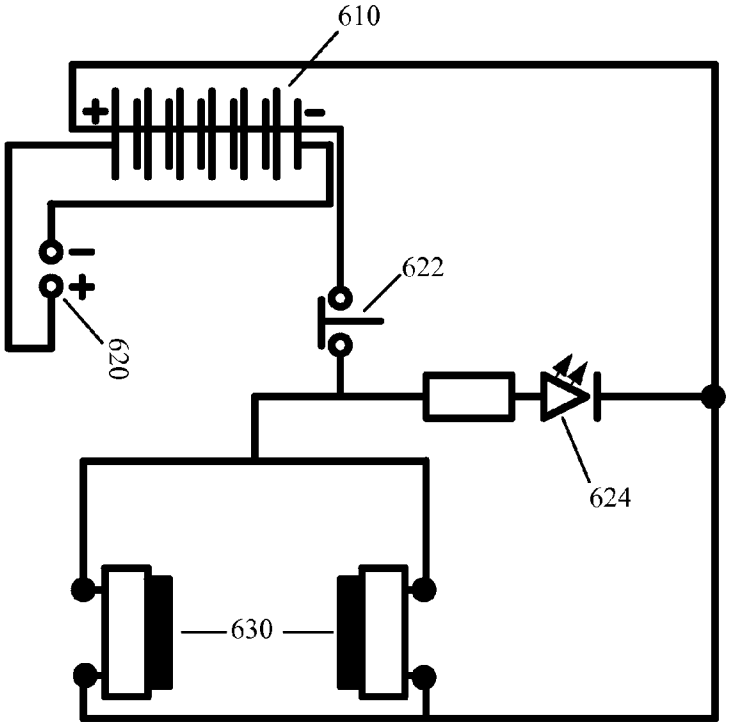
FIGS. 6A-6B are exemplary electrical schematics for an energy storage device and acoustic transducers.
Figure 6A:
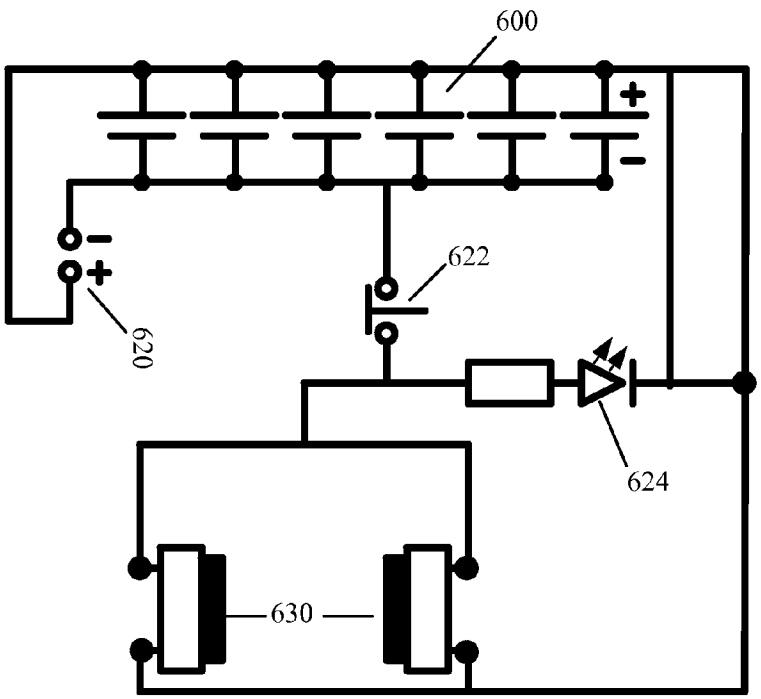

FIGS. 6A-6B are exemplary electrical schematics for an energy storage device and acoustic transducers. As shown in FIG. 6A, an energy storage device 600 can include be formed from single or multiple cells which are electrically interconnected in parallel. The number of cells in the energy storage device 600 can be sufficient to provide adequate electrical power to the acoustic transducers 630, receiver (not shown), and other electronic components contained within the headphones. The energy storage device 600 can be electrically connected to an on/off switch 622, an on/off indicator 624, and acoustic transducers 630. The energy storage device 600 can be electrically connected to the power input port 620 for providing electrical power to recharge the energy storage device 600. Power from the energy storage device 600 can flow to the acoustic transducers 630 when the user activates the on/off switch 622. Upon activating the on/off switch 622, the circuit can close and the on/off indicator 624 can provide a visible signal that power is being supplied to the headphones. The indicator 624 can be an LED indicator and can provide a visible signal that the headphones are receiving electrical power. Upon de-activation of the on/off switch 622, the circuit can open and the on/off indicator 624 can indicate that power is not being provided to the acoustic transducers 630.

As shown in FIG. 6B, an energy storage device 610 can include single or multiple cells connected in series. The number of cells in the energy storage device 610 can be sufficient to provide adequate electrical power to the acoustic transducers 630, receiver (not shown), or other electrical components (not shown) in the headphones. The energy storage device 610 can be electrically connected to an on/off switch 622, and on/off indicator 624, and acoustic transducers 630. The energy storage device 610 can be electronically connected to a power input port 620 which can provide electrical power for recharging the energy storage device 610. Power from the energy storage device 610 flows to the acoustic transducers 630 when the user activates the on/off switch 622. Upon activating the on/off switch 622, the circuit closes and the on/off indicator 624 provides a visible signal that the headphones are on. Upon de-activation of the on/off switch 622, the circuit opens which causes the on/off indicator 624 to no longer provide a signal to the user and no power is provided to the acoustic transducers 630.

Although the present invention has been described in considerable detail with reference to certain preferred embodiments, other embodiments which do not vary from the sprit or scope of this invention are contemplated. Therefore, the appended claims should not be limited to the description of the preferred embodiments contained herein.

It will be apparent to those skilled in the art that various modifications and variations can be made to the headphones having a distributed mass power source without departing from the spirit or scope of the invention. Thus, it is intended that embodiments of the invention cover the modifications and variations of this invention provided they come within the scope of the appended claims and their equivalents.

What is claimed is:

1. A device for audibly producing an audio signal, the device comprising:
- a first speaker;
- a second speaker;
- a first housing surrounding the first speaker;
- a second housing surrounding the second speaker;
- a curved member having a first curvature and connected to the first housing at a first end and the second housing at a second end;
- a bottom layer of the curved member;
- a top layer of the curved member;
- a void formed between the top layer and the bottom layer, the void extending from the first end to the second end;
- a receiver for receiving the audio signal; and
- a battery disposed in the void between the top layer and the bottom layer, the battery electrically connected to the receiver and having a second curvature congruent to the first curvature.

2. The device of claim 1 wherein the curved member is substantially U-shaped.

3. The device of claim 1 wherein the first and second housing are slidably connected to the curved member.

4. The device of claim 1 further comprising an analog audio input electrically connected to the first speaker and second speaker.

5. The device of claim 1 further comprising a power input port electrically connected to the battery.

6. The device of claim 5 wherein the power input is a coaxial power port.

7. The device of claim 5 wherein the power input is a USB port.

8. The device of claim 1 wherein the battery is a flexible rechargeable battery centrally mounted on the curved member.

9. The device of claim 1 wherein the curved member has a midpoint and the battery has a mass and the battery is mounted to the curved member such that half the mass is on each side of the midpoint.

10. The device of claim 1 wherein the battery is a rechargeable battery that is centrally mounted on the curved member.

11. A device for audibly producing an audio signal, the device comprising:
- a first speaker;
- a second speaker;
- a first housing surrounding the first speaker;
- a second housing surrounding the second speaker;
- a curved member having a first curvature and connected to the first housing at a first end and the second housing at a second end;
- a bottom layer of the curved member;
- a top layer of the curved member;

a void formed between the top layer and the bottom layer, the void extending from the first end to the second end;

a receiver for receiving the audio signal; and a plurality of batteries disposed in the void between the top layer and the bottom layer, the plurality of batteries electrically connected to the receiver and each respectively having a second curvature congruent to the first curvature.

12. The device of claim 11 wherein the plurality of batteries comprises a first battery and a second battery and the curved member comprises a first half and a second half, the first battery mounted on the first half and the second battery is mounted on the second half.

13. The device of claim 12 wherein the curved member further comprises a midpoint, the first half is disposed on a first side of the midpoint and the second half is disposed on a second side of the midpoint.

14. The device of claim 13 wherein the plurality of batteries has a mass and the plurality of batteries are mounted to the curved member such that half the mass is disposed on the first half.

15. The device of claim 14 further comprising:

a third battery mounted in the first housing; and a fourth battery mounted in the second housing.

16. A device for audibly producing an audio signal, the device comprising:

a first speaker;

a second speaker;

a first housing surrounding the first speaker;

a second housing surrounding the second speaker;

a curved member having a first curvature, the curved member connected to the first housing at a first end and the second housing at a second end;

a bottom layer of the curved member;

a top layer of the curved member;

a void formed between the top layer and the bottom layer, the void extending from the first end to the second end;

a midpoint of the curved member, the midpoint having a first side and a second side;

a receiver for receiving the audio signal;

a battery disposed in the void between the top layer and the bottom layer, the battery electrically connected to the receiver and having a second curvature congruent to the first curvature;

wherein the battery has a mass;

wherein a first half of the mass is disposed on the first side of the midpoint;

wherein a second half of the mass is disposed on the second side of the midpoint; and wherein the first half of the mass is approximately equal to the second half of the mass.

* * * * *